United States Patent [19]

Hill

[11] 4,309,709

[45] Jan. 5, 1982

[54] DUAL FREQUENCY AERIAL FEED ARRANGEMENTS

[75] Inventor: Stewart C. Hill, Leicester, England

[73] Assignee: The Marconi Company Limited, Chelmsford, England

[21] Appl. No.: 173,911

[22] Filed: Jul. 30, 1980

[30] Foreign Application Priority Data

Aug. 23, 1979 [GB] United Kingdom ..... 29347/79

[51] Int. Cl.[3] ..... H01Q 1/52; H01Q 21/28

[52] U.S. Cl. ..... 343/727; 343/786

[58] Field of Search ..... 343/725, 727, 729, 730, 343/781 R, 786

[56] References Cited

U.S. PATENT DOCUMENTS 3,212,096 10/1965 Schuster et al. ..... 343/781

3,553,707 1/1971 Yang et al. ..... 343/781

3,916,414 10/1975 Trigon et al. ..... 343/727

FOREIGN PATENT DOCUMENTS 782042 8/1957 United Kingdom ..... 343/754

1457907 12/1976 United Kingdom ..... 343/756

*Primary Examiner*—Eli Lieberman

*Attorney, Agent, or Firm*—Spencer & Kaye

[57] ABSTRACT

The invention provides a dual frequency aerial feed arrangement consisting of a main feed horn having on either side of its mouth ground plane members above which are mounted dipole radiators. The ground members are set back from the mouth of the horn and carry upstanding plates extending to a plane including the mouth of the horn the plates providing a corrugation effect with the corrugations aligned with the polarization of the dipole radiators.

3 Claims, 2 Drawing Figures

PRIOR ART

DUAL FREQUENCY AERIAL FEED ARRANGEMENTS

This invention relates to dual frequency aerial feed arrangements.

It is often required to provide an aerial feed which is capable of operation at two frequencies. One example of this requirement is an aerial system utilised in surveillance radar systems in which an IFF (identification friend or foe) facility is provided in addition to the normal surveillance mode of operation.

In the following description, reference will be made to the accompanying drawing in which.

Figure 1:
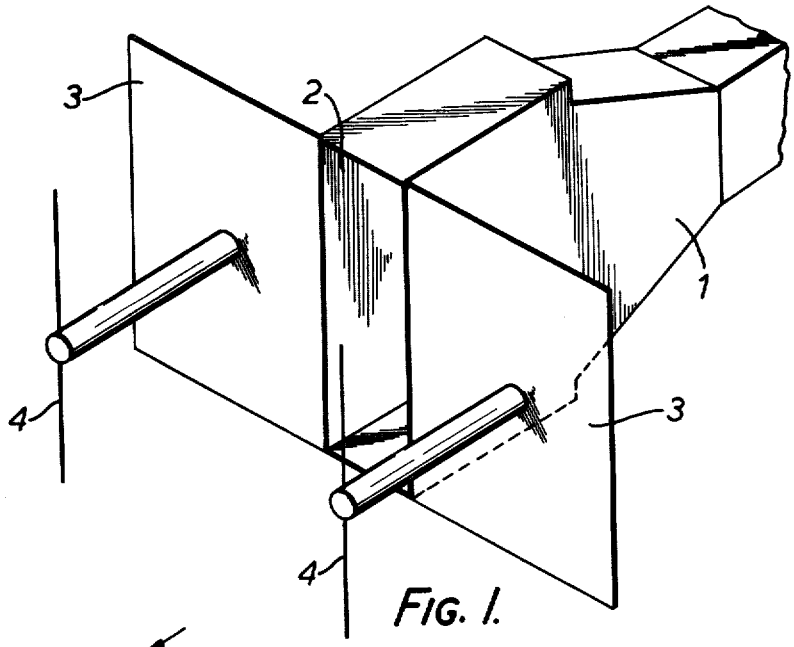
FIG. 1 shows a conventional reflector type aerial combining an IFF feed with a normal feed.

It is known to combine an IFF feed with the normal feed for a common reflector type aerial and one example of this is illustrated in FIG. 1 of the accompanying drawings.

Referring to FIG. 1 the main feed horn is represented at 1 with its mouth 2. On either side of the mouth 2 of the main feed horn 1 are provided conductive sheets 3 forming a ground plane over which are mounted IFF dipoles 4.

A major disadvantage with an arrangement as shown in FIG. 1 is that the ground plane tends to be excited by energy from the main feed horn 1 which causes the main feed to have very wide angle radiation. This wide angled radiation causes high "spill over" lobes to occur in the aerial radiation pattern of the reflector aerial itself.

One object of the present invention is to provide an improved dual frequency aerial feed arrangement in which the above difficulty is mitigated.

According to this invention a dual frequency aerial feed arrangement comprises a main feed horn having on either side of the mouth thereof ground plane members with radiators providing for radiation at a second frequency mounted thereabove and wherein said ground plane members are corrugated.

Preferably said last mentioned radiators are dipole radiators polarised orthogonally with respect to the polarisation of said main feed, the troughs and peaks formed on each member by the corrugations being substantially aligned with each other and with the polarisation of said dipole radiators.

In a particular example of aerial feed arrangement in accordance with the present invention the ground plane members comprise two plates extending transversely to the longitudinal axis of said main feed horn, one on one side of the mouth thereof and the other on the other, each plate having upstanding from the surface thereof facing said dipole radiators a plurality of parallel plates aligned with the polarisation of said dipole radiators.

Preferably said two plates extend in a common plane set back from the mouth of said main feed guide and said upstanding plates extend to a plane containing the mouth of said guide, the depth of a trough formed between adjacent upstanding plates being such as to yield an open circuit at said plane.

Preferably the separations between adjacent upstanding plates are all similar and smaller than half the operating wavelength of the said dipole radiators.

Figure 2:
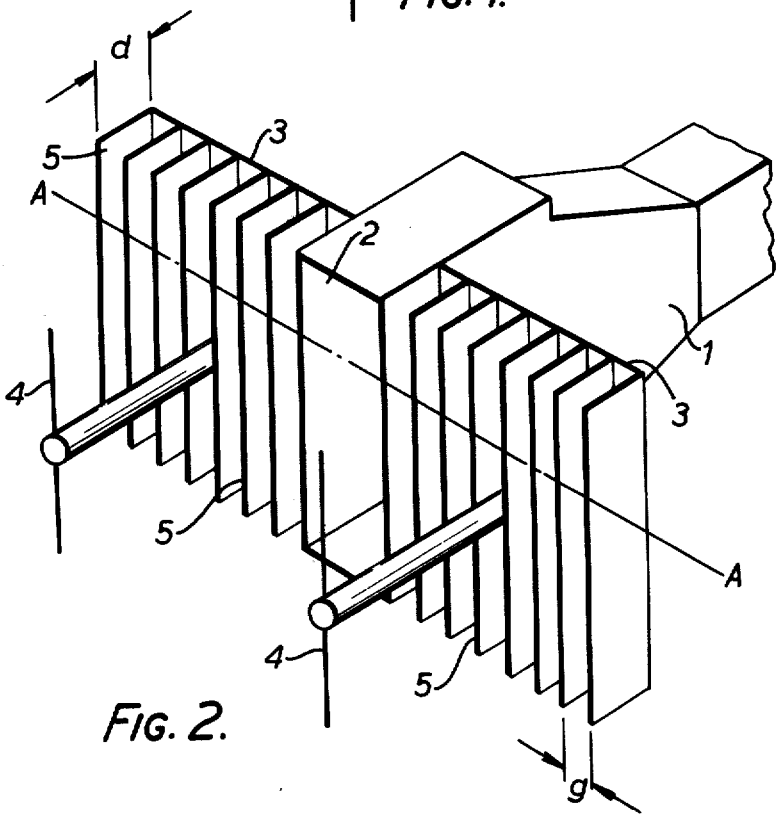
FIG. 2 illustrates the present invention employing flat plates on either side of the mouth of the main feed horn.

The invention is illustrated in and further described with reference to FIG. 2 of the accompanying drawings which illustrates one dual frequency aerial feed arrangement in accordance with the present invention. In FIG. 2 like references are used for like parts in FIG. 1.

Referring to FIG. 2 it will be seen that instead of employing flat plates on either side of the mouth 2 of the main feed horn 1 as in FIG. 1 the plates are set back from the mouth 2 of the main feed horn 1 and a corrugated effect is achieved by the use of upstanding plates such as 5, extending towards the dipole radiators 4. The upstanding plates 5 are all parallel and the separation g between each is similar throughout. The upstanding plates 5 extend from the plates 3 to the plane A . . . A which contains the mouth 2 of the main feed horn 1. As will be seen the "troughs" formed between adjacent upstanding plates 5 and the "peaks" formed by the edges of the upstanding plates 5 opposite plates 3 all extend in a vertical direction as viewed. The dipole radiators 4 are themselves vertically polarised whereas the main feed horn 1 is horizontally polarised. The depth d of a trough between adjacent upstanding plates 5 or in other words the corrugation depth is chosen to yield an open circuit at the plane AA. Because of this open circuit currents are not excited by energy from the main feed horn 1.

The separation g between upstanding plates 5 should be chosen to be smaller than half the operating wavelength of the dipole radiators 4 so as to provide efficient reflection of energy from the dipoles 4 and a satisfactory operation at the dipole frequency.

I claim:

1. A dual frequency aerial feed arrangement comprising a main feed horn for propagating energy at a first frequency and having a first direction of polarization, said feed horn having a longitudinal axis and an open mouth at one end transverse to said longitudinal axis;

a pair of ground plane members extending from opposite sides of said feed horn, said members being located in a first plane parallel to the mouth of said feed horn and spaced therefrom along said longitudinal axis;

a pair of dipole radiators for propagating energy at a second frequency and having a second direction of polarization orthogonal to said first direction of polarization, one of said dipole radiators being mounted on each of said ground plane members; and a plurality of upstanding parallel plates attached to said ground plane members and extending therefrom, the edges of said plates defining a second plane including the mouth of said feed horn, said arrangement minimizing excitation of said ground plane members by energy from said main feed horn thereby reducing the radiation angle of said feed horn.

2. An arrangement as claimed in claim 1 wherein the distance between said first and second planes yields an open circuit at said second plane.

3. An arrangement as claimed in claim 1 or 2 wherein the distance between each of said upstanding parallel plates is the same, said distance being less than one-half of the wavelength corresponding to said second frequency.

* * * * *